US010980328B2

(12) United States Patent
Nikaran et al.

(10) Patent No.: US 10,980,328 B2
(45) Date of Patent: Apr. 20, 2021

(54) FINGERNAIL CLIPPER SAFETY SYSTEM

(71) Applicants: Rami Nikaran, Beverly, CA (US); Michael Eftekhar, Beverly Hills, CA (US)

(72) Inventors: Rami Nikaran, Beverly, CA (US); Michael Eftekhar, Beverly Hills, CA (US)

( * ) Notice: Subject to any disclaimer, the term of this patent is extended or adjusted under 35 U.S.C. 154(b) by 0 days.

(21) Appl. No.: 15/152,551

(22) Filed: May 12, 2016

(65) Prior Publication Data

US 2017/0325567 A1 Nov. 16, 2017

(51) Int. Cl.
*A45D 29/02* (2006.01)

(52) U.S. Cl.
CPC ..... *A45D 29/02* (2013.01)

(58) Field of Classification Search
CPC ..... A45D 29/00; A45D 29/02; A45D 29/023; A45D 2029/026
USPC ..... 30/26–29; D28/60
See application file for complete search history.

(56) References Cited

U.S. PATENT DOCUMENTS 2,774,138 A * 12/1956 Gowdey ..... A45D 29/02 30/28
3,169,312 A 2/1965 Fink
3,189,996 A 6/1965 Casey, Jr.
3,812,868 A 5/1974 Keating
4,637,137 A * 1/1987 Husain ..... A45D 29/02 30/27
4,964,213 A * 10/1990 Suggs ..... A45D 29/02 132/200
4,982,747 A * 1/1991 Shah ..... A45D 29/02 132/75.4
5,323,537 A * 6/1994 Ohori ..... A45D 29/02 132/75.6
5,459,926 A * 10/1995 Perea ..... A45D 29/023 30/28
5,622,191 A * 4/1997 McMullen, Jr. ..... A45D 29/02 132/73
5,918,375 A 7/1999 Rossi, III
D437,458 S 2/2001 Kim
6,557,259 B1 * 5/2003 Nguyen ..... A45D 29/02 30/29
7,024,774 B2 * 4/2006 Novellie ..... A45D 29/023 30/124
7,131,448 B2 11/2006 Lund et al.
(Continued)

FOREIGN PATENT DOCUMENTS

DE 2413887 A1 * 10/1975 ..... A45D 29/02
WO WO-2016093454 A1 * 6/2016 ..... A45D 29/02
WO WO-2017142409 A1 * 8/2017 ..... A45D 29/02

OTHER PUBLICATIONS

Printout of https://www.youtube.com/watch?v=CLL4mgUSHB4; Bocas—Rotary Nail Clipper, Published on Mar. 7, 2012, www.bocas.co.kr.*

*Primary Examiner* — Jason Daniel Prone

(57) ABSTRACT

A fingernail clipper safety system for trimming an infant's fingernails includes a pair of fingernail clippers. The pair of fingernail clippers may be manipulated thereby facilitating the fingernail clippers to trim an infant's fingernails. A guard is coupled to the fingernail clippers. The guard is positioned on the movable jaws to abut the infant's fingertip when the fingernail clippers trim the infant's fingernail. Thus, the fingernail clippers are inhibited from cutting the infant's fingertip.

3 Claims, 4 Drawing Sheets

(56) References Cited

U.S. PATENT DOCUMENTS

| | | | | |
|---|---|---|---|---|
| 8,096,305 | B1 | 1/2012 | Cheney | |
| 9,693,617 | B2 * | 7/2017 | LaTorre | A45D 29/023 |
| 10,420,409 | B1 * | 9/2019 | Crolley | A45D 29/02 |
| D899,692 | S * | 10/2020 | Ishida | D28/60 |
| 10,869,530 | B2 * | 12/2020 | Middelkoop | A01K 17/00 |
| 2004/0200073 | A1 * | 10/2004 | Sakai | A45D 29/02 30/28 |
| 2009/0211098 | A1 * | 8/2009 | Childs, II | A45D 29/02 30/28 |
| 2016/0324293 | A1 * | 11/2016 | Wheeler | A45D 29/023 |
| 2016/0330937 | A1 * | 11/2016 | Peschardt | A45D 29/02 |
| 2019/0125057 | A1 * | 5/2019 | Gittens | A45D 29/023 |

* cited by examiner

FINGERNAIL CLIPPER SAFETY SYSTEM

BACKGROUND OF THE DISCLOSURE

Field of the Disclosure

The disclosure relates to safety devices and more particularly pertains to a new safety device for inhibiting fingernail clippers from cutting an infant's fingertip.

SUMMARY OF THE DISCLOSURE

An embodiment of the disclosure meets the needs presented above by generally comprising a pair of fingernail clippers. The pair of fingernail clippers may be manipulated thereby facilitating the fingernail clippers to trim an infant's fingernails. A guard is coupled to the fingernail clippers. The guard is positioned on the movable jaws to abut the infant's fingertip when the fingernail clippers trim the infant's fingernail. Thus, the fingernail clippers are inhibited from cutting the infant's fingertip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
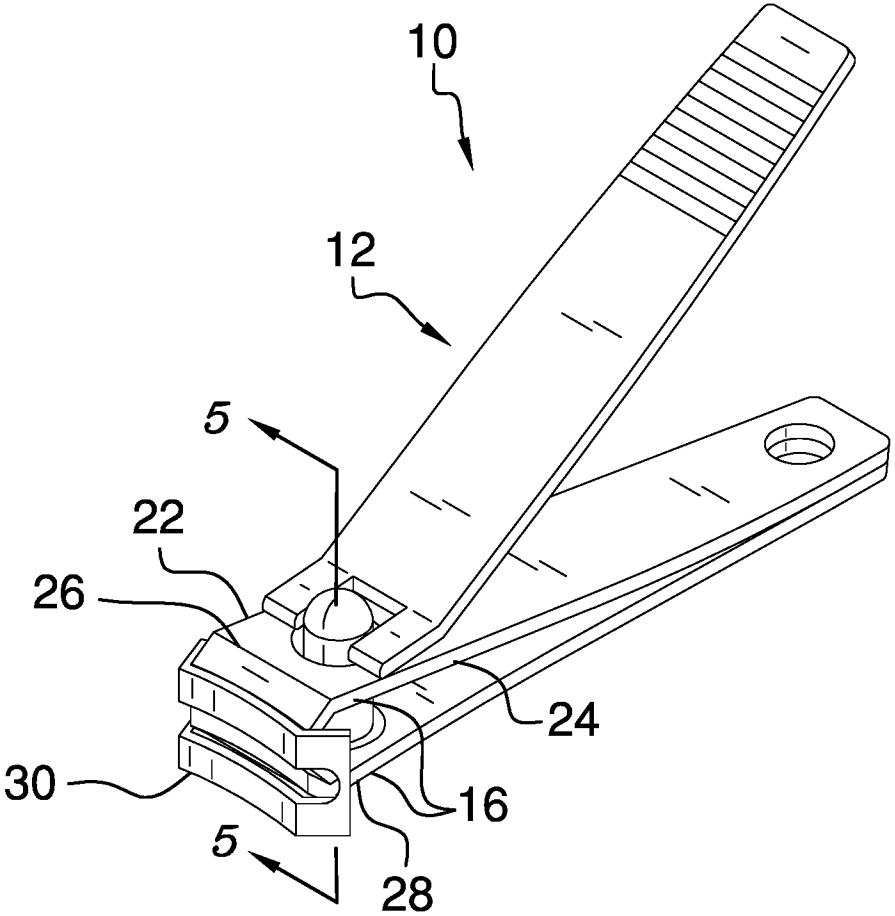
FIG. 1 is a perspective view of a fingernail clipper safety system according to an embodiment of the disclosure.
Figure 3:
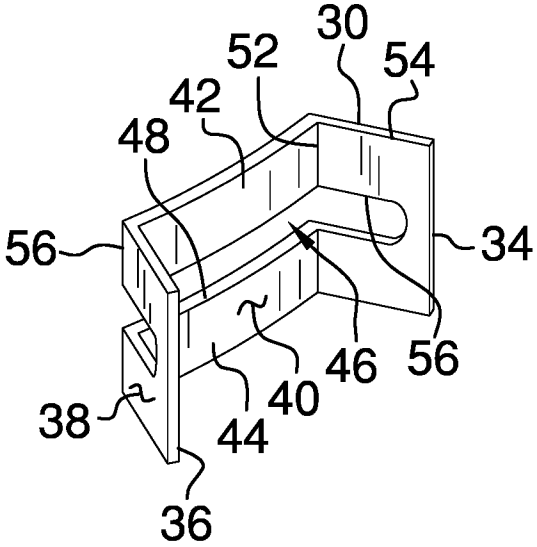
FIG. 3 is a back perspective view of a guard of an embodiment of the disclosure.
Figure 4:
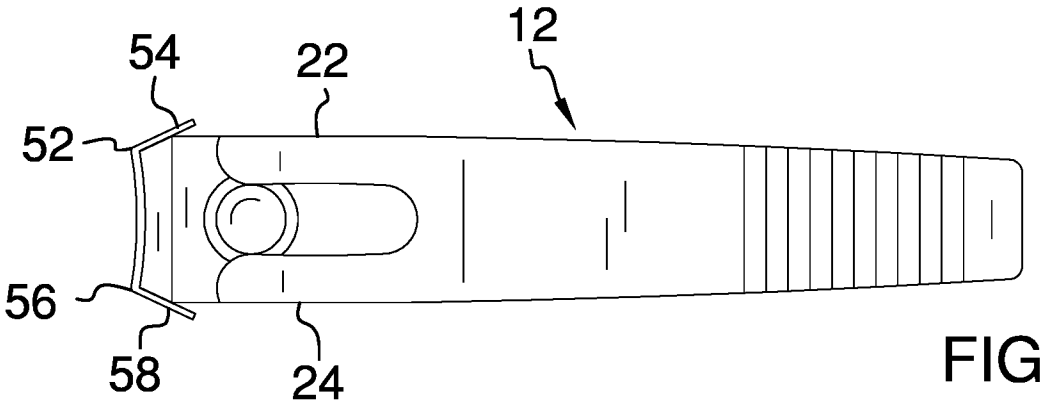
FIG. 4 is a top view of an embodiment of the disclosure.
Figure 2:
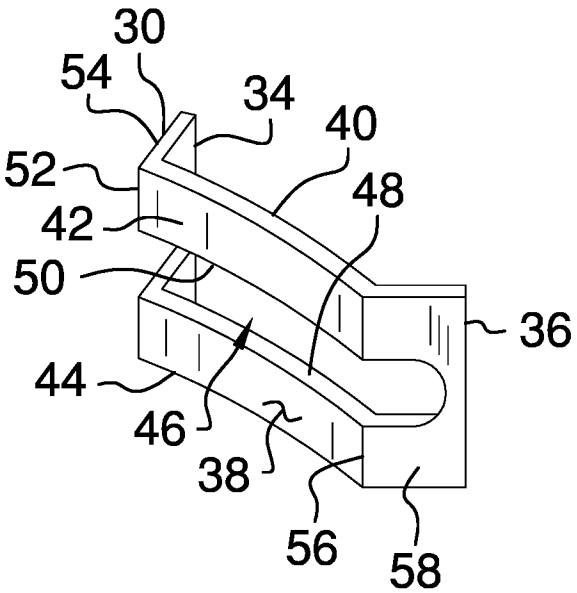
FIG. 2 is a front perspective view of guard of an embodiment of the disclosure.
Figure 5:
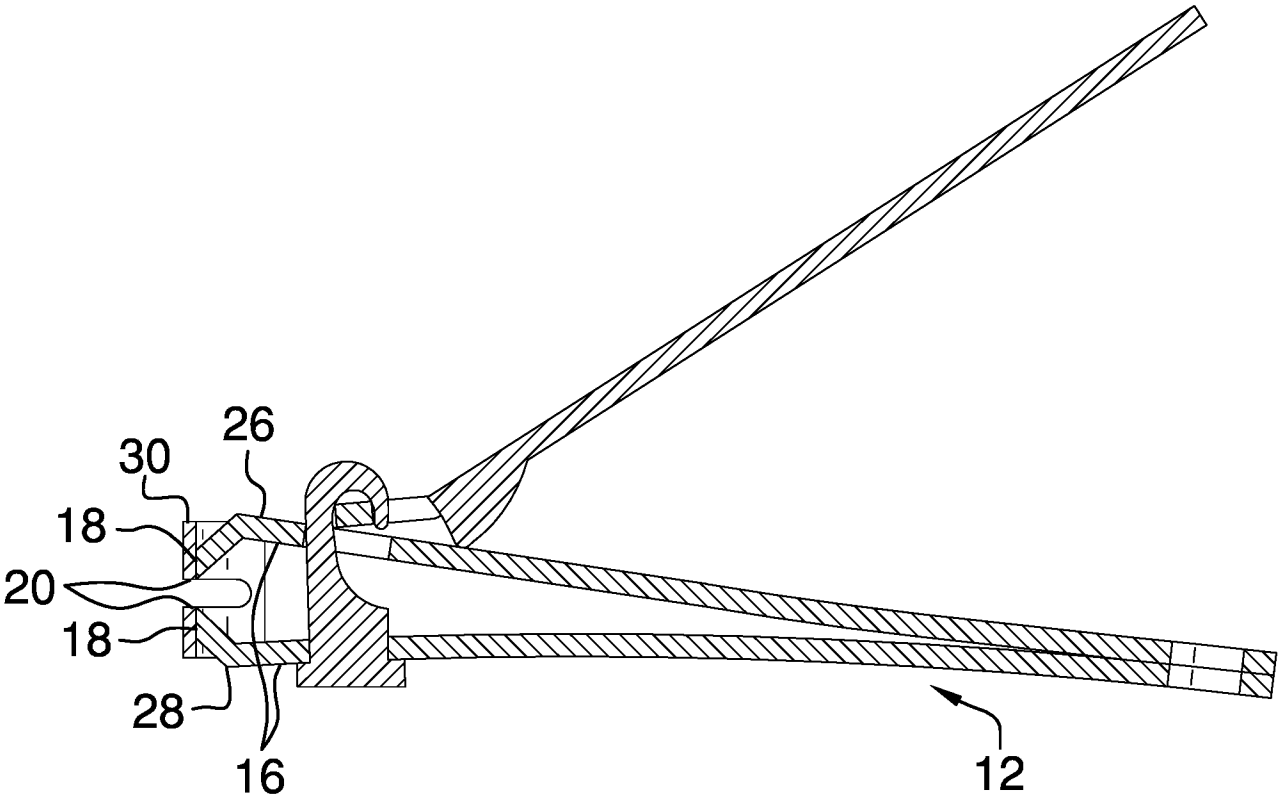
FIG. 5 is a cross sectional view taken along line 5-5 of FIG. 1 of an embodiment of the disclosure.
Figure 6:
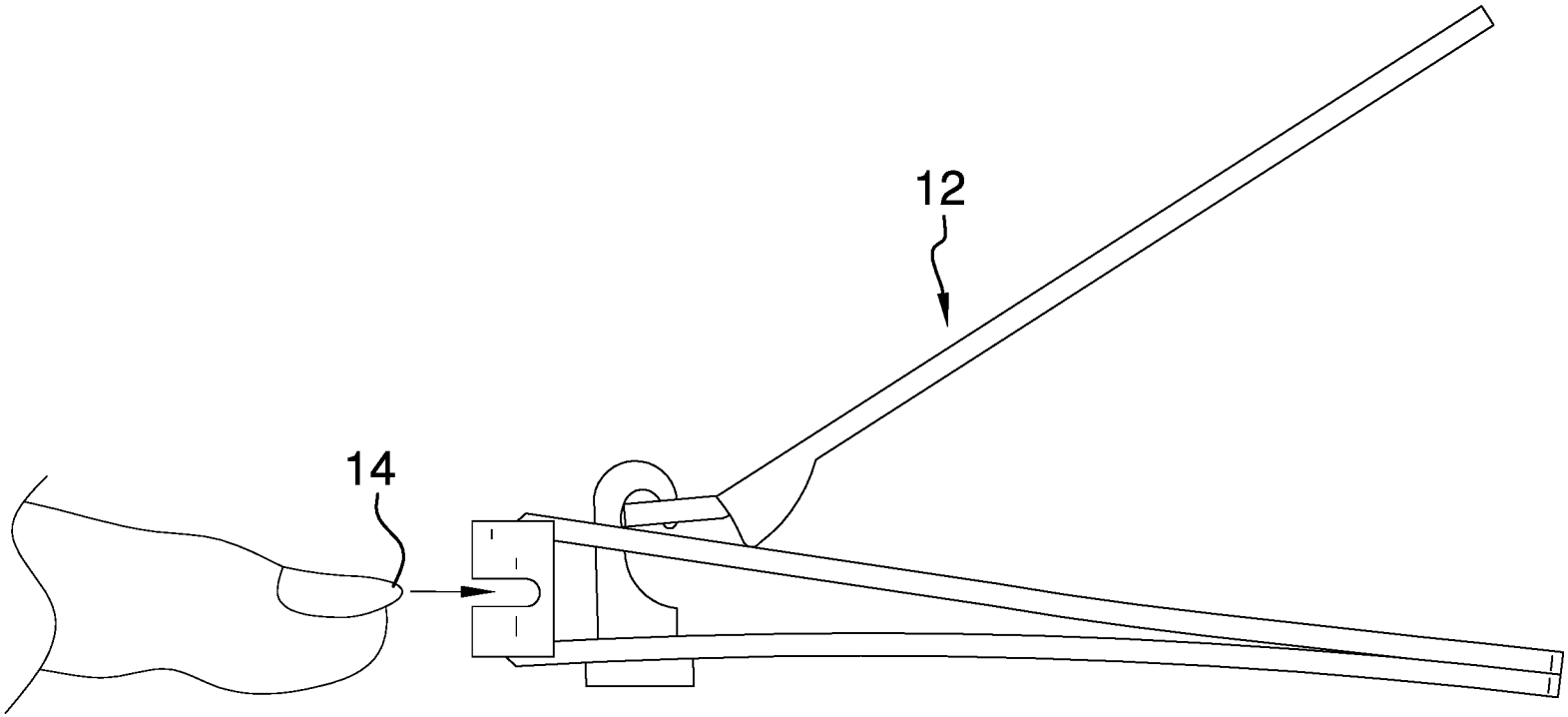
FIG. 6 is a perspective in-use view of an embodiment of the disclosure.

With reference now to the drawings, and in particular to FIGS. 1 through 6 thereof, a new safety device embodying the principles and concepts of an embodiment of the disclosure and generally designated by the reference numeral 10 will be described.

As best illustrated in FIGS. 1 through 6, the fingernail clipper safety system 10 generally comprises a pair of fingernail clippers 12. The pair of fingernail clippers 12 may be manipulated thereby facilitating the fingernail clippers 12 to trim an infant's fingernails 14. The pair of fingernail clippers 12 has a pair of movable jaws 16. Each of the movable jaws 16 has an outwardly facing surface 18, a cutting edge 20, a first lateral edge 22 and a second lateral edge 24. The pair of movable jaws 16 includes an upper jaw 26 and a lower jaw 28. The pair of fingernail clippers 12 may be fingernail clippers of any conventional design.

A guard 30 is provided and the guard 30 is coupled to the fingernail clippers 12. The guard 30 is positioned on the movable jaws 16 to abut the infant's fingertip 32 when the fingernail clippers 12 trim the infant's fingernail 14. Thus, the fingernail clippers 12 are inhibited from cutting the infant's fingertip 32. The guard 30 has a first end 34, a second end 36, a front surface 38 and a back surface 40.

The guard 30 further includes a top strip 42 and a bottom strip 44. The first end 34 corresponding to the top strip 42 is coupled to the first end 34 corresponding to the bottom strip 44. The second end 36 corresponding to the top strip 42 is coupled to the second end 36 corresponding to the bottom strip 44. The top strip 42 is spaced from the bottom strip 44 to define a channel 46 between the top strip 42 and the bottom strip 44. The channel 46 extends substantially between the first end 34 and the second end 36.

The top strip 42 has a lower edge 50 and the bottom strip 44 has an upper edge 48. The back surface 40 corresponding to the bottom strip 44 is coupled to the outwardly facing surface 18 of the lower jaw 28. The cutting edge 20 of the lower jaw 28 is aligned with the upper edge 48 of the bottom strip 44. The cutting edge 20 of the upper jaw 26 is aligned with the lower edge 50 of the top strip 42.

The outwardly facing surface 18 corresponding to the upper jaw 26 slidably engages the back surface 40 corresponding to the top strip 42. Thus, the upper jaw 26 is urgeable toward the lower jaw 28 when the fingernail clippers 12 are manipulated. The guard 30 may be comprised of a rigid material such as metal or the like. The guard 30 may be welded to the outwardly facing surface 18 of the lower jaw 28. Alternatively, an adhesive may adhere the guard 30 to the outwardly facing surface 18 of the lower jaw 28.

The guard 30 has a first bend 52 and the first bend 52 extends vertically along each of the top strip 42 and the bottom strip 44. The first bend 52 is positioned closer to the first end 34 than the second end 36 to define a first wing 54. The first wing 54 extends rearwardly along the first lateral edge 22 of the movable jaws 16. The guard 30 has a second bend 56 and the second bend 56 extends vertically along each of the top strip 42 and the bottom strip 44. The second bend 56 is positioned closer to the second end 36 than the first end 34 to define a second wing 58. The second wing 58 extends rearwardly along the second lateral edge 24 of the movable jaws 16.

In use, the fingernail clippers 12 are manipulated to clip the infant's fingernails 14. The front surface 38 of the guard 30 abuts the infant's fingertips 32 when the fingernail clippers 12 trim the infant's fingernails 14. The channel 46 may have the infant's fingernails 14 extended therethrough thereby facilitating the movable jaws 16 to cut the infant's fingernails 14. The fingernail clippers 12 are manipulated to urge the upper jaw 26 toward the lower jaw 28 thereby clipping the infant's fingernails 14.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A fingernail clipper safety system comprising:

a pair of fingernail clippers having first and second movable jaws, each of said movable jaws having a cutting edge, a first lateral edge, and a second lateral edge, said pair of fingernail clippers being configured to be manipulated thereby allowing said cutting edges of the movable jaws to cooperate to trim fingernails;

a guard having a first strip with first and second end portions and a second strip with first and second end portions, said first end portion of said first strip is connected to said first end portion of said second strip to define a first end of said guard, said second end portion of the first strip is connected to said second end portion of said second strip to define a second end of said guard, said first strip has a first bend and a second bend, said second strip has a third bend and a fourth bend, said first and third bends are collinear, closer to said first end of said guard than said second end of said guard, and define a first wing, said first wind includes said first end portions of said strips and said first end of said guard, said second and fourth bends are collinear, are closer to said second end of said guard than said first end of said guard, and define a second wing, said second wing includes said second end portions of said strips and said second end of said guard, said first strip being spaced from said second strip to define a channel therebetween, said channel extends alongside said bends so that a first end of said channel is located in said first wing and a second end of said channel is located in said second wing, one of said strips is coupled to one of said jaws so that said first wing extends rearwardly along said first lateral edges, said second wing extends rearwardly along said second lateral edges, and said ends of said channel are rearwardly offset from said cutting edges;

and, wherein said strips abut a user's fingertip while a fingernail is received in said channel to be trimmed by said cutting edges.

2. The system according to claim 1, further comprising said first strip comprises front and back surfaces and said second strip comprises front and back surfaces, said back surface of said one of said strips is coupled to said one of said jaws, said front surfaces of said strips abut the user's fingertip; and wherein said back surfaces of said strips together define a back surface of said guard, and said front surfaces of said strips together define a rear surface of said guard.

3. The system according to claim 2, further comprising each of said movable jaws having an outwardly facing surface defining a respective one of the cutting edges, and wherein said back surface of said one of said strips is coupled to said outwardly facing surface of said one of said jaws.

* * * * *